US007703608B2

(12) United States Patent
Hsu

(10) Patent No.: US 7,703,608 B2
(45) Date of Patent: Apr. 27, 2010

(54) PACKING MECHANISM FOR INKJET CARTRIDGES FOR USE INSIDE OF A PRINTER

(76) Inventor: Yu-Ching Hsu, No. 8, Lane 22, Renwu 1st St., Hsinpu Town, Hsin-Chu Hsien (TW)

( * ) Notice: Subject to any disclaimer, the term of this patent is extended or adjusted under 35 U.S.C. 154(b) by 309 days.

(21) Appl. No.: 11/379,231

(22) Filed: Apr. 19, 2006

(65) Prior Publication Data

US 2006/0233586 A1 Oct. 19, 2006

(30) Foreign Application Priority Data

Apr. 19, 2005 (TW) ..... 94112418 A

(51) Int. Cl.
*B65D 69/00* (2006.01)

(52) U.S. Cl. ..... 206/576; 206/320; 206/592

(58) Field of Classification Search ..... 206/521, 206/320, 525, 525.1, 591, 592, 594, 576; 400/691, 693

See application file for complete search history.

(56) References Cited

U.S. PATENT DOCUMENTS 5,335,846 A * 8/1994 Smith et al. ..... 206/594
5,398,808 A * 3/1995 Chen et al. ..... 206/320
5,669,496 A * 9/1997 Daniels ..... 206/320
6,685,025 B1 * 2/2004 Kari ..... 206/583

FOREIGN PATENT DOCUMENTS

JP P2001-138495 A 5/2001

* cited by examiner

*Primary Examiner*—Luan K Bui
(74) *Attorney, Agent, or Firm*—Perkins Coie LLP

(57) ABSTRACT

An inkjet cartridge packing mechanism having a cartridge storage box and a carrier fixer that uses the inside of a printer for storing an inkjet cartridge in order to save packing space of the printer. The packing mechanism further attaches the carrier of the printer to the carrier fixer and fixes a plurality of star wheels at the paper-feeding outlet by a flap connected to the carrier fixer, which can prevent movement of the carrier or dropping of the plurality of star wheels during transport. The saving of packing space by the packing mechanism can effectively reduce cost for transporting printers.

22 Claims, 5 Drawing Sheets

PACKING MECHANISM FOR INKJET CARTRIDGES FOR USE INSIDE OF A PRINTER

BACKGROUND OF INVENTION

1. Field of the Invention

The present invention relates to a packing mechanism for inkjet cartridges, and more specifically, to a packing mechanism for inkjet cartridges for use inside of a printer.

2. Description of the Prior Art

Most multifunctional printers are sold with disposable inkjet cartridges, which are commonly packed in pulp cushioning materials, such as Styrofoam, or even by adding paper partitions. Since additional space is needed for cartridges, the size of a printer box must be enlarged—this will increase the cost of transport per single machine.

On the other hand, a carrier inside a printer is a moving part of the machine. The prior art printer fixes the carrier to one side inside the printer with a simple dowel or adhesive tape to prevent any collisions caused by the carrier. Unfortunately, the adhesive tape sometimes comes off and the simple dowel still requires extra modification on the body of the printer. Also, some printers have star rollers at the outlet of the machine, which are likely to shift or fall during transport. Thus, the prior art printers need additional modification to protect the carrier and the star rollers, or require additional expense to pay for collision damage, if no protection is provided.

SUMMARY OF INVENTION

Therefore, the primary objective of the claimed invention is to provide a packing mechanism for inkjet cartridges for use inside of a printer to solve these problems.

The claimed invention provides a packing mechanism for inkjet cartridges for use inside of a printer. The packing mechanism comprises a carrier fixer having a plurality of slits, which allow a plurality of holders of a carrier to extend therein and fasten the carrier fixer to the carrier, and a cartridge storage box installed on the carrier fixer capable of holding an inkjet cartridge.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
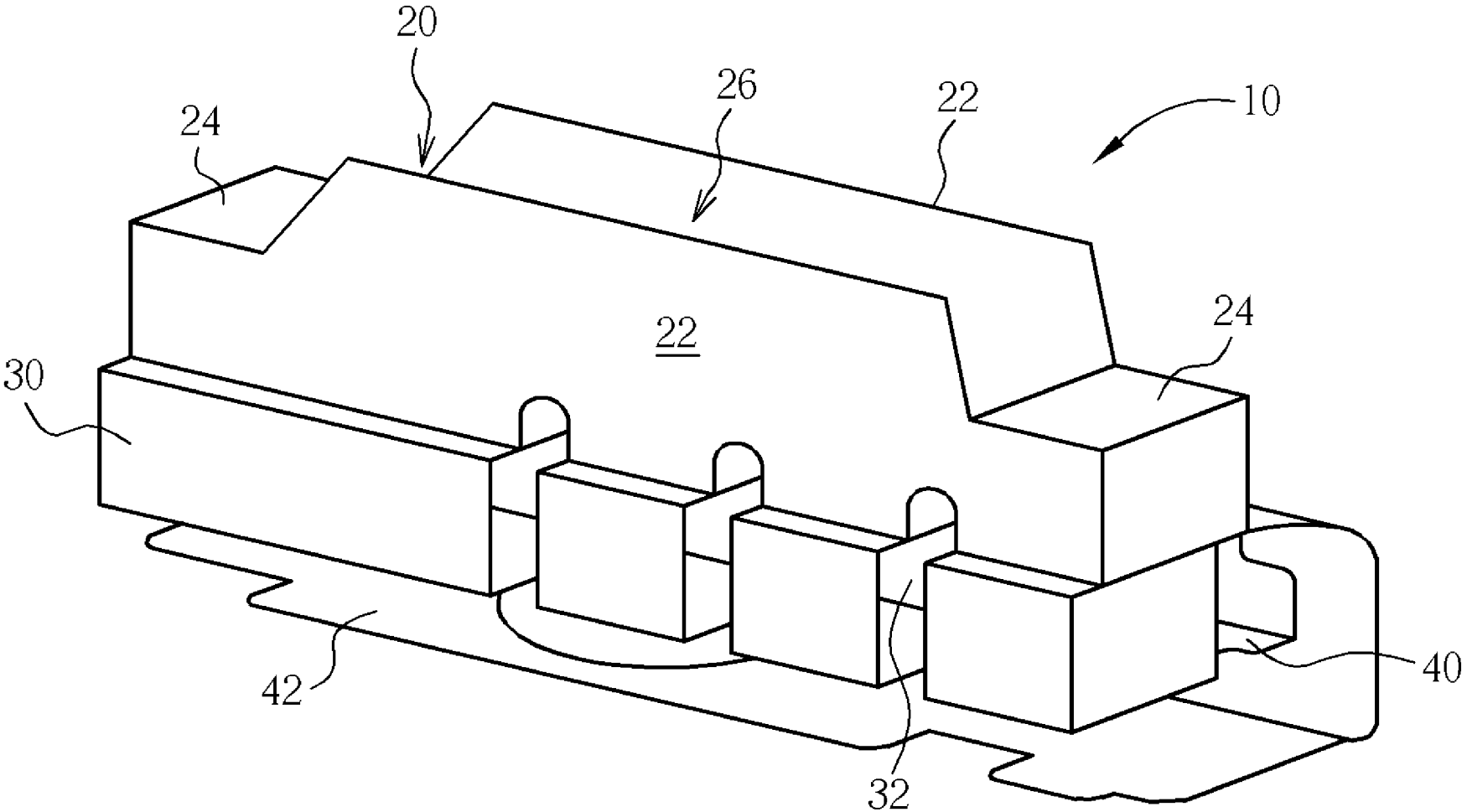
FIG. 1 illustrates a front view of the present invention packing mechanism for inkjet cartridges.
Figure 2:
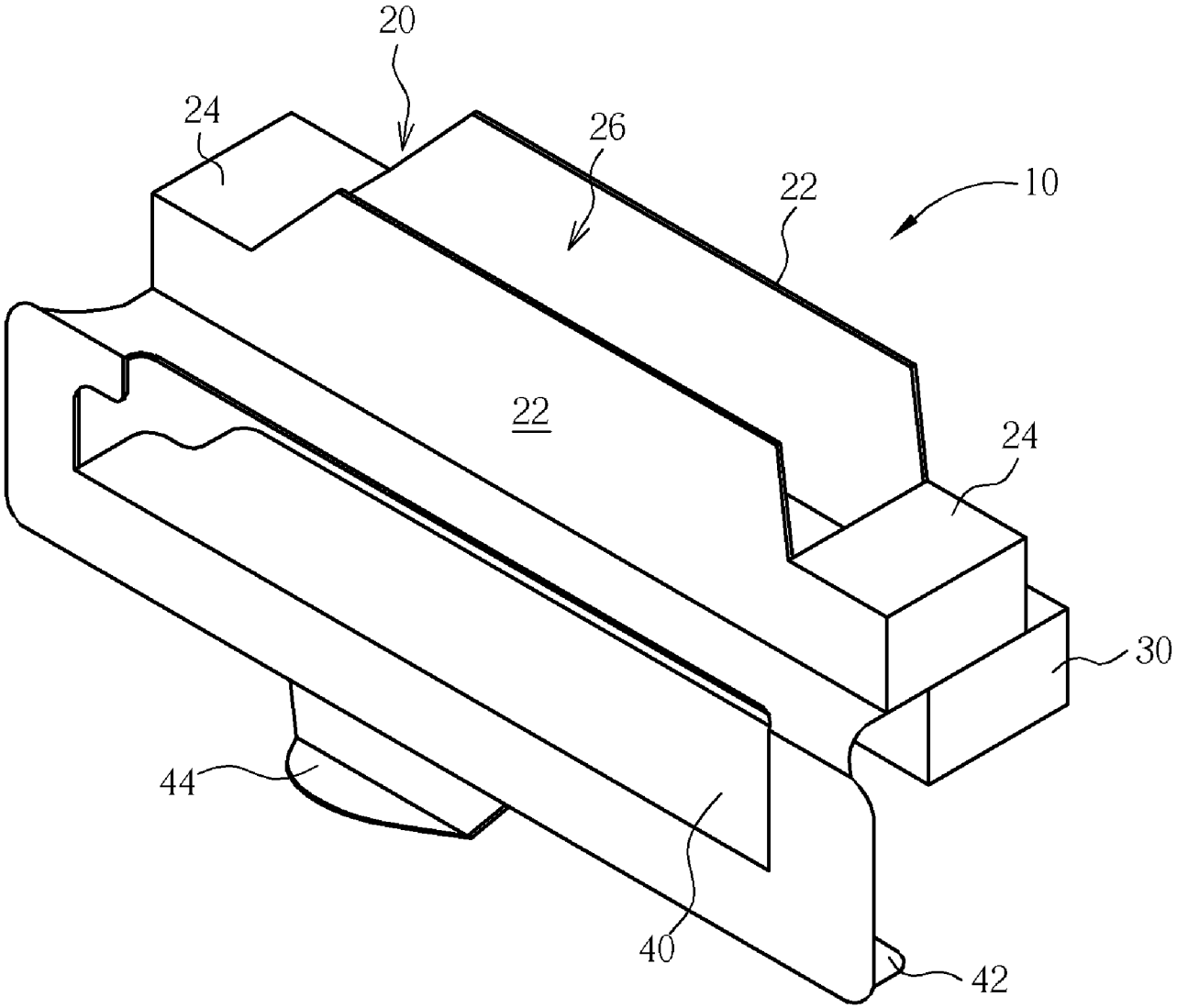
FIG. 2 illustrates a rear view of the packing mechanism for inkjet cartridges in FIG. 1.
Figure 3:
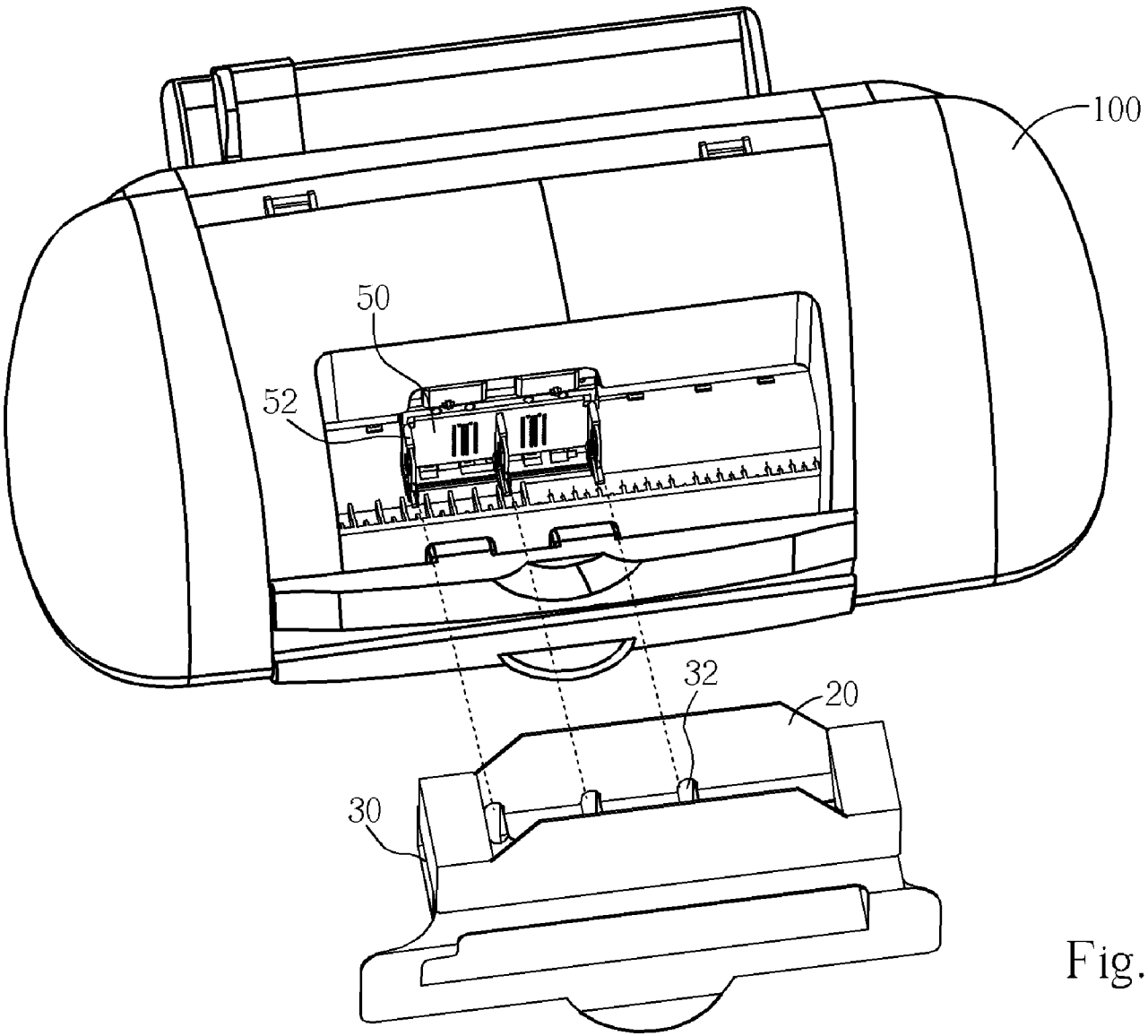
FIG. 3 illustrates how a carrier fixer attaches to a carrier.

Please refer to FIG. 1 and FIG. 2. FIG. 1 illustrates a front view of the present invention packing mechanism 10 for inkjet cartridges. FIG. 2 illustrates a rear view of the packing mechanism 10 in FIG. 1. The packing mechanism 10 comprises a cartridge storage box 20, a carrier fixer 30, a main flap 40, an auxiliary supporting flap 42 and a tab 44. Please refer to FIG. 3 together with FIG. 1 and FIG. 2. FIG. 3 illustrates how a carrier fixer attaches to a carrier. The carrier fixer 30 comprises a plurality of slits 32 for allowing a plurality of holders 52 of a carrier 50 in a printer 100 to extend therein and fasten the carrier fixer 30 to the carrier 50. The cartridge storage box 20 is installed on the carrier fixer 30 for holding an inkjet cartridge.

The carrier fixer 30 is a rectangular tube. The space between each adjacent pair of the plurality of slits 32 on the carrier fixer 30 equals to the distance between each adjacent pair of the holders 52 on the carrier 50. If the printer 100 is a color printer 100 and the carrier 50 is capable of installing two cartridges, then there should be three holders 52 that lead to three corresponding slits 32 set up on the carrier fixer 30. During the packing stage of manufacturing of the printer 100, the carrier 50 is placed in order for the plurality of holders 52 of the carrier 50 to extend into the plurality of slits 32 of the carrier fixer 32. Since, once they are inside the slits 32, there is no room for the holders 52 of the carrier 50 to move, and the carrier 50 is restricted from sliding around in the printer 100 during transport, which prevents unexpected damage of the carrier 50.

Please refer to FIG. 1 and FIG. 2 again. The cartridge storage box 20 of the present invention packing mechanism 10 is installed above the carrier fixer 30. Except for the space taken up by the carrier 50, which has been fixed by the carrier fixer 30 of the packing mechanism 10, there is still some space inside the printer 100. Therefore, the cartridge storage box 20 above the carrier fixer 30 can be used for holding some unused cartridges, which will save more packing space. The cartridge storage box 20 is an open box where a space 26 is formed between two plates 22 and two caps 24 for holding the cartridges. The space 26 has a proper size for holding the cartridges; the plates 22 and the caps 24 can tightly enclose the cartridges. Thus the cartridges will not collide with other parts inside the printer 100 during transport.

Figure 4:
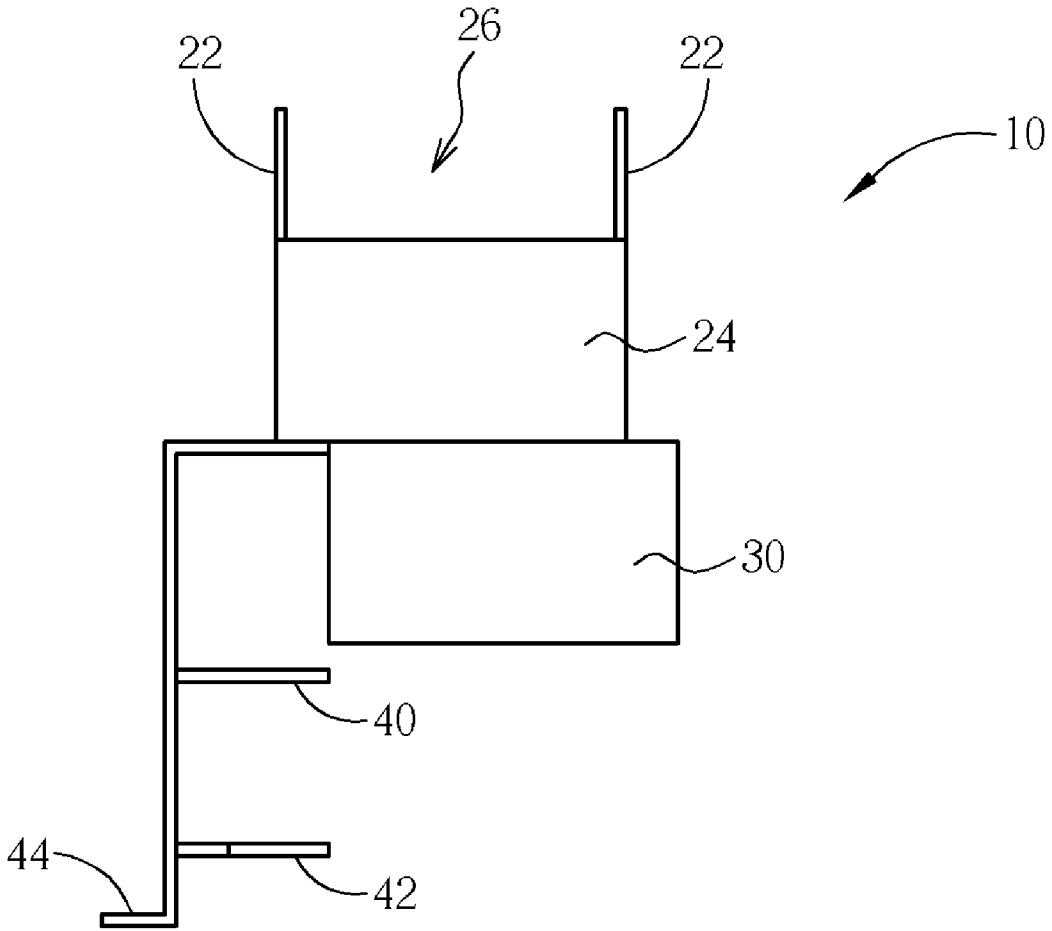
FIG. 4 is an illustration of part of the packing mechanism including a main flap, an auxiliary supporting flap and a tab.
Figure 5:
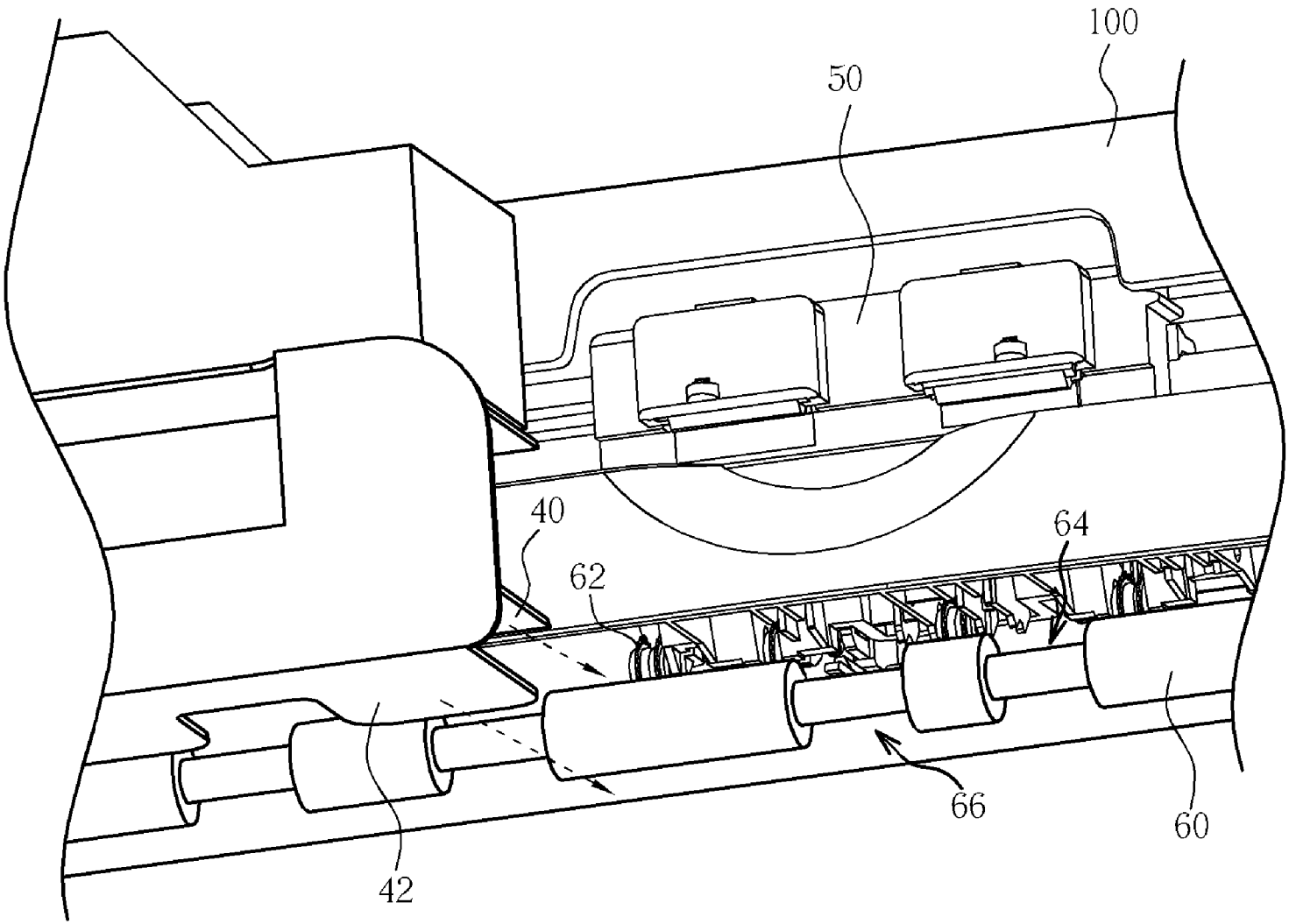
FIG. 5 illustrates how the main flap and the auxiliary supporting flap in FIG. 4 are inserted into a first and a second opening, respectively.

Please refer to FIG. 4 and FIG. 5. FIG. 4 is an illustration of part of the packing mechanism 10 including a main flap 40, an auxiliary supporting flap 42 and a tab 44. FIG. 5 illustrates how the main flap 40 and the auxiliary supporting flap 42 in FIG. 4 are inserted into a first opening 64 and a second opening 66 respectively. The packing mechanism 10 further has a main flap 40 connected outside to the carrier fixer 30 for insertion into the first opening 64, between a plurality of rollers 60 and a plurality of star rollers 62, for stabilizing the plurality of star rollers 62. The plurality of rollers 60 and the plurality of star rollers 62 are for moving the paper out of the printer 100. The paper moves out from the first opening 64 with the printing surface facing up. Therefore, the plurality of rollers 60 under the first opening 64 are high friction rollers 64, while the plurality of star rollers 62 above the first opening 64, when lowered onto the printing paper, contact least possible surface area of the paper, due to the star shape of the star rollers 62. The plurality of star rollers 62 are linked successively by springs, which in turn rest upon a holder of the first opening 64, and thus the star rollers 62 are likely to shift or fall during transport. The main flap 40 of the present invention, when inserted into the first opening 64 between the plurality of rollers 60 and the plurality of star rollers 62, can effectively stabilize the plurality of star rollers 62, solving the problem of shifting or falling of the star rollers 62.

Additionally, to give more strength to the main flap 40 of the present invention packing mechanism 10, the auxiliary supporting flap 42 is further connected to the main flap 40, where the auxiliary supporting flap 42 is for insertion into the second opening 66 of the printer 100 for pressing the packing mechanism 10 close to the printer 100. The packing mechanism 10 further comprises a tab 44 connected to the auxiliary supporting flap 42 for pulling the main flap 40 and the auxiliary supporting flap 42 when the tab 44 is pulled. The main flap 40 and the auxiliary supporting flap 42 are inserted into the first opening 64 and the second opening 66 of the printer 100, respectively. After purchasing the printer 100, a user can use the tab 44 to easily pull the whole packing mechanism 10 out of the printer 100. That is, the tab 44 helps the user to dismount the packing mechanism 10.

The present invention packing mechanism 10 uses the cartridge storage box 20, the carrier fixer 30 and the main flap 40 for fully utilizing the space inside of the printer 100. Holding cartridges in this way saves more space for packing. Meanwhile, the carrier 50 and the star rollers 62 at the outlet can be stabilized, preventing collision during transport, which solves the problem of the prior art remarkably. The packing mechanism 10 can be made of cardboard, plastic, or other suitable materials, with a single piece or multiple pieces. The packing mechanism 100 can be applied not only to a printer 100 but also any multifunctional machine that has a function similar to the printer 100.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A printer and packing mechanism combination configured to store one or more inkjet cartridges inside the printer, the printer comprising a plurality of cartridge holders extending from a cartridge carrier, and the packing mechanism comprising:

a carrier fixer having a body with a generally elongated tubular shape and a plurality of slits in a side portion of the body, wherein the slits extend substantially perpendicular to a longitudinal axis of the body, wherein each of the slits is configured to receive one of the corresponding cartridge holders and couple the carrier fixer to the cartridge carrier; and a cartridge storage box at an external surface of the carrier fixer, wherein the cartridge storage box is configured to hold the one or more inkjet cartridges, and wherein the cartridge storage box is at least partially received inside the printer.

2. The printer and packing mechanism combination of claim 1, further comprising a flap extending from the carrier fixer, wherein the printer further comprises an opening between a plurality of first rollers and a plurality of second rollers, and wherein the flap is inserted in the opening and stabilizes the plurality of second rollers.

3. The printer and packing mechanism combination of claim 2 wherein the flap is a first flap and the packing mechanism further comprises a second flap extending from the carrier fixer and spaced apart from the first flap, and wherein the second flap is positioned adjacent to the plurality of first rollers and at least partially retains the carrier fixer adjacent to the cartridge holder.

4. The printer and packing mechanism combination of claim 3, further comprising a tab coupled to the second flap, wherein the tab is configured to remove the first flap from the opening and the second flap from the printer when the tab is pulled.

5. The printer and packing mechanism combination of claim 1 wherein the packing mechanism is cardboard.

6. The printer and packing mechanism combination of claim 1 wherein the carrier fixer restricts movement of the cartridge carrier.

7. The printer and packing mechanism combination of claim 1 wherein the cartridge storage box further comprises an opening defined by a first sidewall opposite a second sidewall, a first cap member extending between the first and second sidewalls at a first end portion of the cartridge storage box, and a second cap member extending between the first and second sidewalls at a second end portion of the cartridge box.

8. A packing device and printer combination for storing one or more inkjet printer cartridges in the printer, the printer comprising cartridge holders extending from a cartridge carrier, the packing device comprising:

a carrier fixer portion configured to restrict movement of the cartridge carrier, wherein the cartridge fixer portion comprises a plurality of openings that receive the corresponding cartridge holders and retain the cartridge carrier in a generally stationary position; and a cartridge storage portion coupled to the carrier fixer portion, wherein the cartridge storage portion comprises a storage space configured to store the one or more inkjet printer cartridges.

9. The packing device and printer combination of claim 8 wherein the cartridge storage portion further comprises:

a base having a first end portion opposite a second end portion;

a first sidewall opposite a second sidewall, wherein the first and second sidewalls extend from the base; and a first cap member extending between the first and second sidewalls at the first end portion of the base, and a second cap member extending between the first and second sidewalls at the second end portion of the base;

wherein the base, first and second sidewalls, and first and second cap members define the storage space.

10. The packing device and printer combination of claim 8 wherein:

the printer further comprises a first set of rollers that engage a second set of rollers; and the packing device further comprises a retention portion extending from the carrier fixer portion, and wherein the retention portion is positioned between the first and second sets of rollers and retains the packing device proximate to the printer, and further wherein the retention member at least partially resists movement of the second set of rollers.

11. The packing device and printer combination of claim 10 wherein the retention member is a first retention member, and wherein the packing device further comprises a second retention member extending from the carrier fixer portion and spaced apart from the first retention member, and further wherein the second retention member is positioned to be in contact with the first set of rollers and at least partially retain the packing device adjacent to the cartridge holder.

12. The packing device and printer combination of claim 8 wherein the carrier fixer portion is integrally formed with the cartridge storage portion.

13. The packing device and printer combination of claim 8 wherein the carrier fixer portion is separate from the cartridge storage portion and attached to the cartridge storage portion.

14. The packing device and printer combination of claim 8 wherein the packing device is configured to immobilize the cartridge carrier during transport of the printer, and wherein the packing device is removable from the printer for operation of the printer.

15. The packing device and printer combination of claim 8 wherein the plurality of openings of the cartridge fixer portion comprise a plurality of first openings, and wherein the cartridge storage portion further comprises a plurality of second openings, wherein each of the second openings is aligned with one of the corresponding first openings, and wherein each of the second openings receives the corresponding cartridge holder and retains the corresponding cartridge carrier in a generally stationary position.

16. A combination of a printer and a packing device for removably securing one or more ink cartridges inside the printer, the printer comprising a cartridge carrier and a set of rollers, the packing device comprising:

a cartridge storage portion configured to receive the one or more ink cartridges and retain the one or more ink cartridges inside the printer during a non-operational mode of the printer; and a printer fixer portion coupled to the cartridge storage portion, wherein the printer fixer portion engages the cartridge carrier and the set of rollers and immobilizes the cartridge carrier and the set of rollers during the non-operational mode of the printer.

17. The combination of claim 16 wherein the printer fixer portion includes a plurality of openings that each receives a corresponding extension from the cartridge carrier to immobilize the cartridge carrier.

18. The combination of claim 16 wherein:

the set of rollers is a first set of rollers and the printer further comprises a second set of rollers that contact the first set of rollers; and the printer fixer portion further comprises a flap configured to be positioned between the first and second set of rollers to immobilize the first set of rollers.

19. A printer and packing device combination for retaining one or more ink cartridges in the printer, the printer comprising a cartridge carrier and a plurality of rollers, the packing device comprising:

first means for storing the one or more ink cartridges within the printer while the printer is in a non-operational mode;

second means for stabilizing the cartridge carrier while the printer is in the non-operational mode; and third means for stabilizing the plurality of rollers while the printer is in the non-operational mode.

20. The combination of claim 19 wherein the first means comprises:

a cartridge storage compartment having a storage space defined by a first sidewall extending from a base and a second sidewall extending from the base and spaced apart from the first sidewall;

a first cap member extending between the first and second sidewalls at a first end portion of the storage compartment; and a second cap member extending between the first and second sidewalls at a second end portion of the storage compartment opposite the first end portion.

21. The combination of claim 19 wherein the second means comprises a cartridge fixer portion having a generally rectangular tubular shape with a plurality of slots configured to receive corresponding cartridge holders extending away from the cartridge carrier to restrain movement of the cartridge carrier.

22. The combination of claim 19 wherein the set of rollers is a first set of rollers, and wherein the printer further comprises a second set of rollers, and further wherein the third means comprises a flap positioned between the first and second sets of rollers to restrain movement of the first set of rollers.

* * * * *